US009999307B2

(12) United States Patent
Feldman

(10) Patent No.: US 9,999,307 B2
(45) **Date of Patent: *Jun. 19, 2018**

(54) FITTED SHEET

(71) Applicant: GHCL Limited, Uttar Pradesh (IN)

(72) Inventor: Nancy Feldman, Woodbury, NY (US)

(73) Assignee: GHCL Limited, Uttar Pradesh (IN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/795,726

(22) Filed: Oct. 27, 2017

(65) Prior Publication Data

US 2018/0042407 A1 Feb. 15, 2018

Related U.S. Application Data

(63) Continuation of application No. 14/737,926, filed on Jun. 12, 2015, now Pat. No. 9,820,592.

(51) Int. Cl.
*A47G 9/02* (2006.01)

(52) U.S. Cl.
CPC ..... *A47G 9/0246* (2013.01)

(58) Field of Classification Search
CPC .... A47G 9/0246; A47C 21/022; A47C 27/022
USPC ..... 108/90; 150/158; 297/224
See application file for complete search history.

(56) References Cited

U.S. PATENT DOCUMENTS

| | | | | |
|---|---|---|---|---|
| 3,013,283 | A | 12/1961 | Steffinich | |
| 3,111,688 | A | 11/1963 | Barnes | |
| 3,290,702 | A | 12/1966 | Seltzer | |
| 3,789,441 | A * | 2/1974 | Weiss | A47G 9/0246 5/497 |
| 4,703,530 | A | 11/1987 | Gusman | |
| 4,892,353 | A | 1/1990 | Goddard | |
| 4,922,565 | A | 5/1990 | Blake | |
| 4,980,941 | A | 1/1991 | Johnson, III | |
| 5,003,655 | A | 4/1991 | Kafai | |
| 6,594,836 | B1 | 7/2003 | Everson et al. | |
| 7,240,383 | B2 | 7/2007 | Stewart | |
| 8,733,835 | B2 | 5/2014 | Ulfig | |
| 2013/0042411 | A1 | 2/2013 | Vitale | |
| 2014/0109315 | A1 | 4/2014 | Lilienthal | |

* cited by examiner

*Primary Examiner* — Eric J Kurilla
(74) *Attorney, Agent, or Firm* — Buchanan Ingersoll & Rooney PC

(57) ABSTRACT

A fitted sheet which will fit both a standard-size twin mattress and an XL-size twin mattress without undue wrinkling or bunching of fabric is disclosed. This fitted sheet has a top panel, a first side panel attached to the top panel, a second side panel attached to the top panel, a front panel attached to the top panel, the first side panel and the second side panel, and a rear panel attached to the top panel, the first side panel and the second side panel. An elastic strip is proved near each corner or near two corners at one end of the fitted sheet. The elastic strips are oriented lengthwise on the fitted sheet and allow the fitted sheet to stretch and contract only in a lengthwise direction.

6 Claims, 4 Drawing Sheets

FITTED SHEET

CROSS REFERENCE TO RELATED APPLICATION

This is a continuation of U.S. patent application Ser. No. 14/737,926 filed Jun. 12, 2015.

FIELD OF THE INVENTION

The present invention is directed towards a sheet for a mattress, and in particular to a fitted sheet that will cover twin mattresses of different lengths.

BACKGROUND OF THE INVENTION

Fitted sheets are typically configured to cover a substantial portion of a mattress and engage the mattress to obviate undesired movement of the fitted sheet. Typically, fitted sheets are provided with at top panel, side panels extending from the edges of the top panel and elastic along all of the edges of the side panels or along the edges of two opposite side panels. The side panels are sized so that a portion of the side panels can be tucked underneath the mattress and held in place by the elastic.

Most fitted sheets are sized to match the dimensions of a twin-size mattress, double-size mattress, queen-size mattress or king-size mattress so that the side panels conform to the sides and corners of the mattress to enable a close-fitting engagement with the mattress. Because these fitted sheets are designed for a close-fit engagement with a selected size or type of mattress they do not fit well on mattresses of other sizes. Gusman in U.S. Pat. No. 4,703,530 discloses a fitted sheet that he says will fit a range of mattress sizes without undue wrinkling or bunching of the fabric. This sheet has elastic along the corner seams which is intended to gather the fabric is all directions beneath the mattress. To enable the sheet to fit all sizes of mattresses the sheet must contain enough fabric to cover the largest mattress. For that reason this sheet will be more expensive than most other fitted sheets.

In U.S. Pat. No. 4,980,941 Johnson discloses a fitted sheet having elastic portions in each corner which enables the fitted sheet to fit securely over mattresses that vary in length, width and thickness. Each elastic portion extends from the bottom hem formed by the side panels toward the top panel. The elastic portion has a woven outer layer, an elastic intermediate layer and a woven backing layer. The patent teaches at column 2, lines 65-66, that "All that is important is that the intermediate layer 22 be elastic in two dimensions." Like the fitted sheet disclosed by Gusman, this fitted sheet is also more expensive because the sheet must contain enough fabric to cover the largest mattress. Furthermore, the elastic corners are noticeable, can be distracting and give the sheet a very different appearance than a conventional fitted sheet.

Twin-size mattresses are sold in a standard size and an XL size. Both mattress sizes have the same width but the XL-size twin mattress is five inches longer, having a length of 80 inches compared to 75 inches for a standard-size twin mattress. The XL-size twin mattress is commonly used in college dormitory rooms while the twin beds in most homes are a standard length. Consequently, college students and their parents are required to purchase XL-size twin sheets for the bed in the college dormitory room. Because the XL-size twin sheets are longer than standard-size twin sheets the fitted XL-size twin sheet will not fit well on a standard-size twin mattress. Wrinkling and undue bunching occurs. Hence college students who live in a college dormitory must have one set of sheets for college and another set of twin-size sheets for home.

There is a need for one fitted sheet that can be used on both a standard-size twin mattress and on an XL-size twin mattress without undue wrinkling or bunching of the fabric on the standard-size twin mattress and without slipping off the XL-size twin mattress.

SUMMARY OF THE INVENTION

A fitted sheet which will fit both a standard-size twin mattress and an XL-size twin mattress without undue wrinkling or bunching of fabric is disclosed. This fitted sheet has a top panel, a first side panel attached to the top panel, a second side panel attached to the top panel, a front panel attached to the top panel, the first side panel and the second side panel, and a rear panel attached to the top panel, the first side panel and the second side panel. An enclosed first front corner is formed at a junction of the top panel the front panel and the first side panel. An enclosed second front corner is formed at a junction of the top panel, the front panel and the second side panel. An enclosed first rear corner is formed at a junction of the top panel, the rear panel and the first side panel. And, an enclosed second rear corner is formed at a junction of the top panel, the rear panel, and the second side panel. A first front elastic strip is attached to either or both of the top panel and the first side panel adjacent the first front corner and a second front elastic strip is attached to either or both of the top panel and the second side panel adjacent the second front corner. Both elastic strips extend toward the rear panel. Elastic is attached to the edges of both side panels, the edge of the front panel and the edge of the rear panel. Alternatively, elastic can be attached only to the edge of the first side panel and to the edge of the second the side panel. Because elastic strips can be stretched and contract only in a lengthwise direction, the elastic strips allow the fitted sheet to stretch only in a lengthwise direction.

In another preferred embodiment, a first rear elastic strip attached to either or both of the top panel and the first side panel adjacent the first rear corner and a second rear elastic strip is attached to either or both of the top panel and the second side panel adjacent the second rear corner. Both elastic strips extend toward the front panel and enable the fitted sheet to be stretched and contract only in a lengthwise direction.

When this fitted sheet is placed on a standard size twin mattress, the elastic strips contract and constrict the fitted sheet's lengthwise dimension to enable the fitted sheet to form a close-fit engagement with the standard twin sized mattress. When this fitted sheet is placed on an XL-size twin mattress, the elastic strips are forced to expand, allowing the fitted sheet to expand lengthwise and to form a close-fit engagement with the XL-size twin mattress.

While exemplary embodiments describe and illustrate the device being employed as a fitted sheet for a mattress used on a twin bed, one skilled in the art will appreciate that the fitted sheet could be sized to fit both a standard length mattress and a similar longer or shorter mattress that may be used in a camper, other recreational vehicle or other location.

BRIEF DESCRIPTION OF THE DRAWINGS

The above and other objects, aspects, features, advantages, and possible applications of the present invention will be more apparent from the following more particular description of certain present preferred embodiments shown in the drawings, in which.

DETAILED DESCRIPTION OF THE PREFERRED EMBODIMENTS

The following description is of certain resent preferred embodiments of the present invention. This description is not to be taken in a limiting sense, but is made merely for the purpose of describing the general principles and features of the present invention. The scope of the present invention should be determined with reference to the claims.

Figure 1:
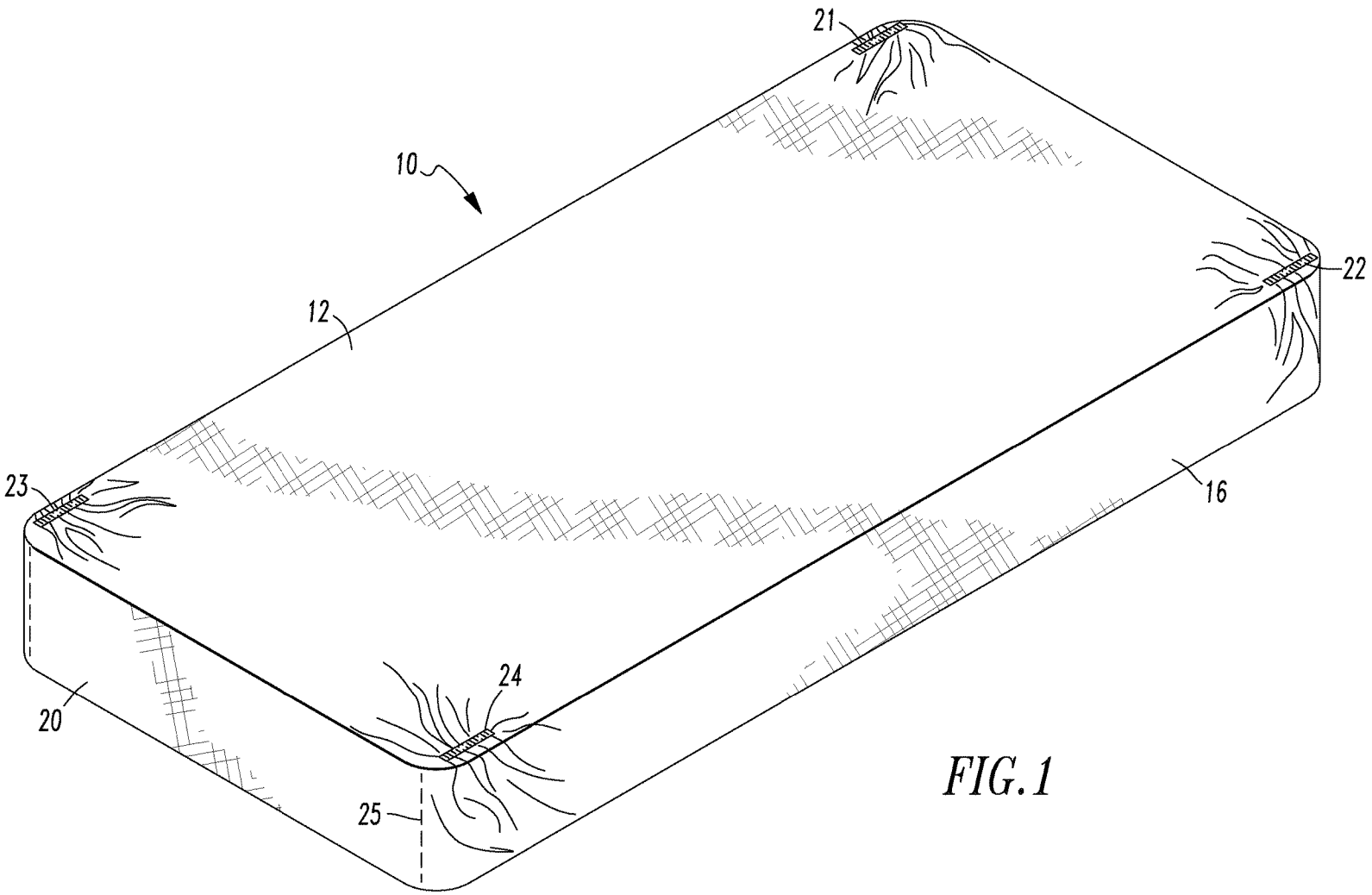
FIG. 1 is a perspective view of a present preferred embodiment of the fitted sheet on a standard-size twin mattress.
Figure 2:
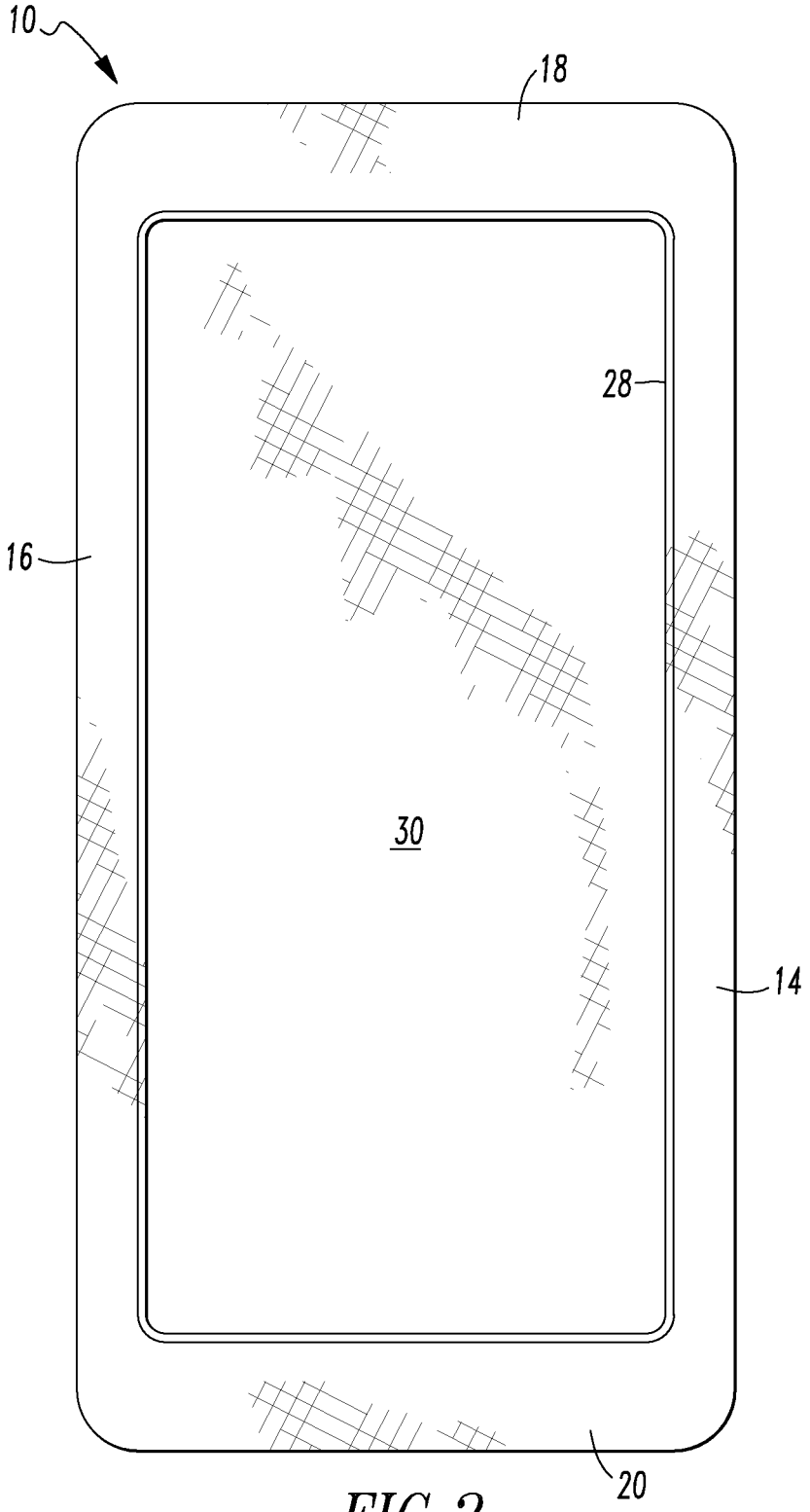
FIG. 2 is bottom view of the fitted sheet shown in FIG. 1.
Figure 3:
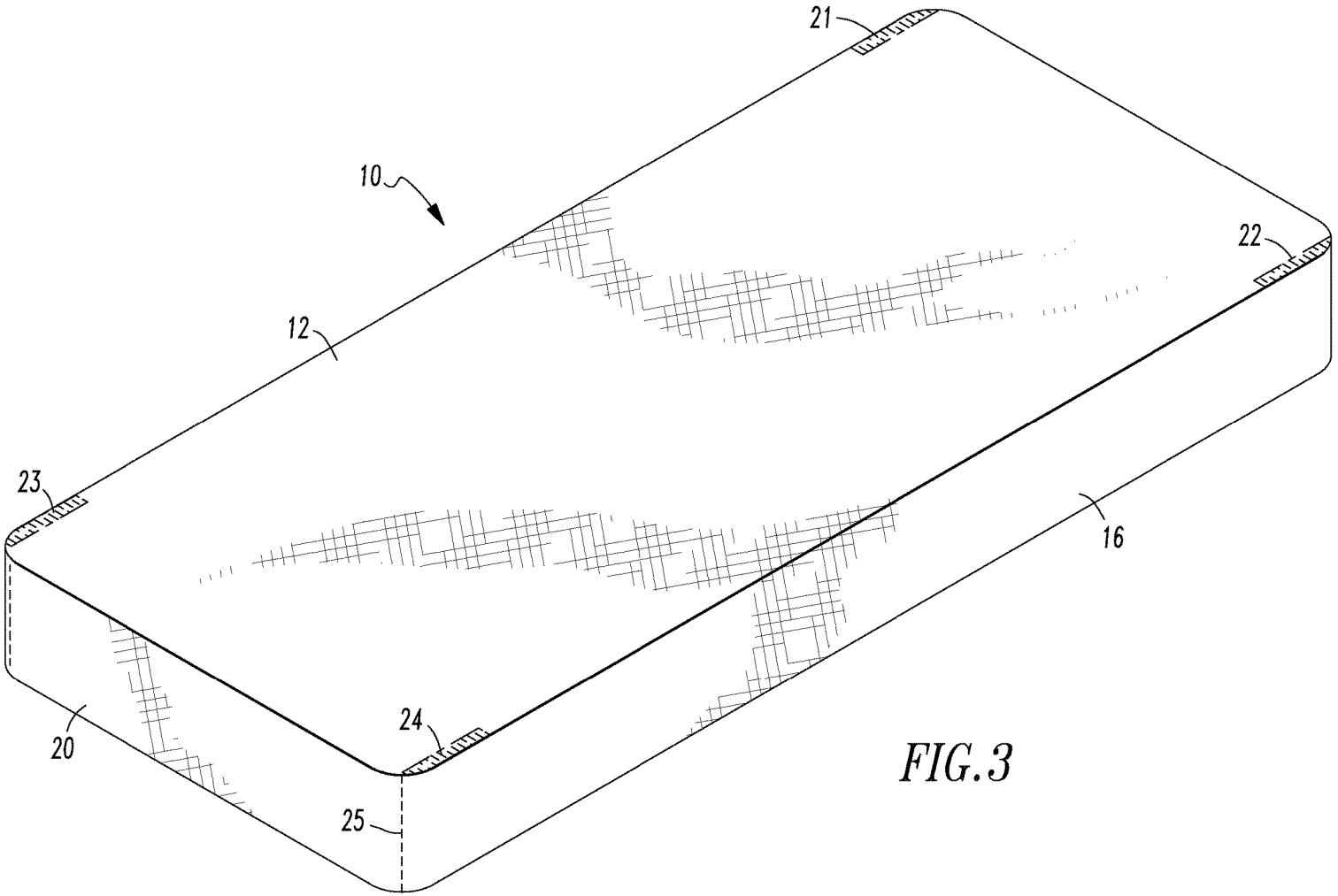
FIG. 3 is a perspective view of a present preferred embodiment of the fitted sheet of FIG. 1 on an XL-size twin mattress.

A present preferred embodiment of the fitted sheet 10 placed on a standard size twin mattress 30 is shown in FIGS. 1 and 2. The same sheet is shown on an XL-size twin mattress 32 in FIGS. 3 and 4. Because the fitted sheet and the mattresses are symmetrical the perspective views shown in FIG. 1 and FIG. 3 would be the same if either the front panel of the fitted sheet or the rear panel of the fitted sheet were in the foreground. The fitted sheet 10 has a top panel 12, a first side panel 14, a second side panel 16, a front panel 18, and a rear panel 20. An enclosed first front corner is formed at a junction of the top panel 12, the front panel 18 and the first side panel 14. An enclosed second front corner is formed at a junction of the top panel 12, the front panel 18 and the second side panel 16. An enclosed first rear corner is formed at a junction of the top panel 12, the rear panel 20 and the first side panel 14. An enclosed second rear corner is formed at a junction of the top panel 12, the rear panel 20 and the second side panel 16. A first front elastic strip 21 is attached to the top panel 12 adjacent the first front corner and a second front elastic strip 22 is attached to the top panel 12 adjacent the second front corner. Both elastic strips 21, 22 extend toward the rear panel 20. As can be seen in FIGS. 1 and 3 the elastic strips have a length which is greater than their width and they are oriented so that the strip is lengthwise substantially parallel to the adjacent side panel. Because elastic strips can be stretched and contract only in a lengthwise direction, the elastic strips allow the fitted sheet to stretch and contract only in a lengthwise direction.

Although the use of two elastic strips may be sufficient, I prefer to provide four elastic strips as shown in FIGS. 1 and 3. A first rear elastic strip 23 is attached to the top panel 12 adjacent the first rear corner extending toward the first front corner, A second rear elastic strip 24 is attached to the top panel 12 adjacent the second rear corner extending toward the second front corner. When the fitted sheet is placed on a standard-size twin mattress the fabric will be gathered near the elastic strips. Using four elastic strips rather than two elastic strips reduces the amount of wrinkling and bunching of fabric near each elastic strip.

In a present preferred embodiment like that shown in the drawings the elastic strips are ¼ inch (0.635 cm.) wide and 2.5 inches (6.35 cm.) long when fully contracted. These strips double in length to 5 inches (12.5 cm.) when fully expanded. Wider or longer elastic strips could be used. I prefer to position these elastic strips so that one end of each strip abuts the end of the seam 25 that joins a side panel to either the front panel or the rear panel.

Although the elastic strips 21, 22, 23 and 24 are illustrated as being attached to the top panel, these strips could be attached to a side panel or at the junction of the side panel and the top panel. While these elastic strips should be near the corners it is not necessary that one end of the strip abut a corner. One could provide additional elastic strips at other locations, but such additional elastic strips add costs to the product.

Figure 4:
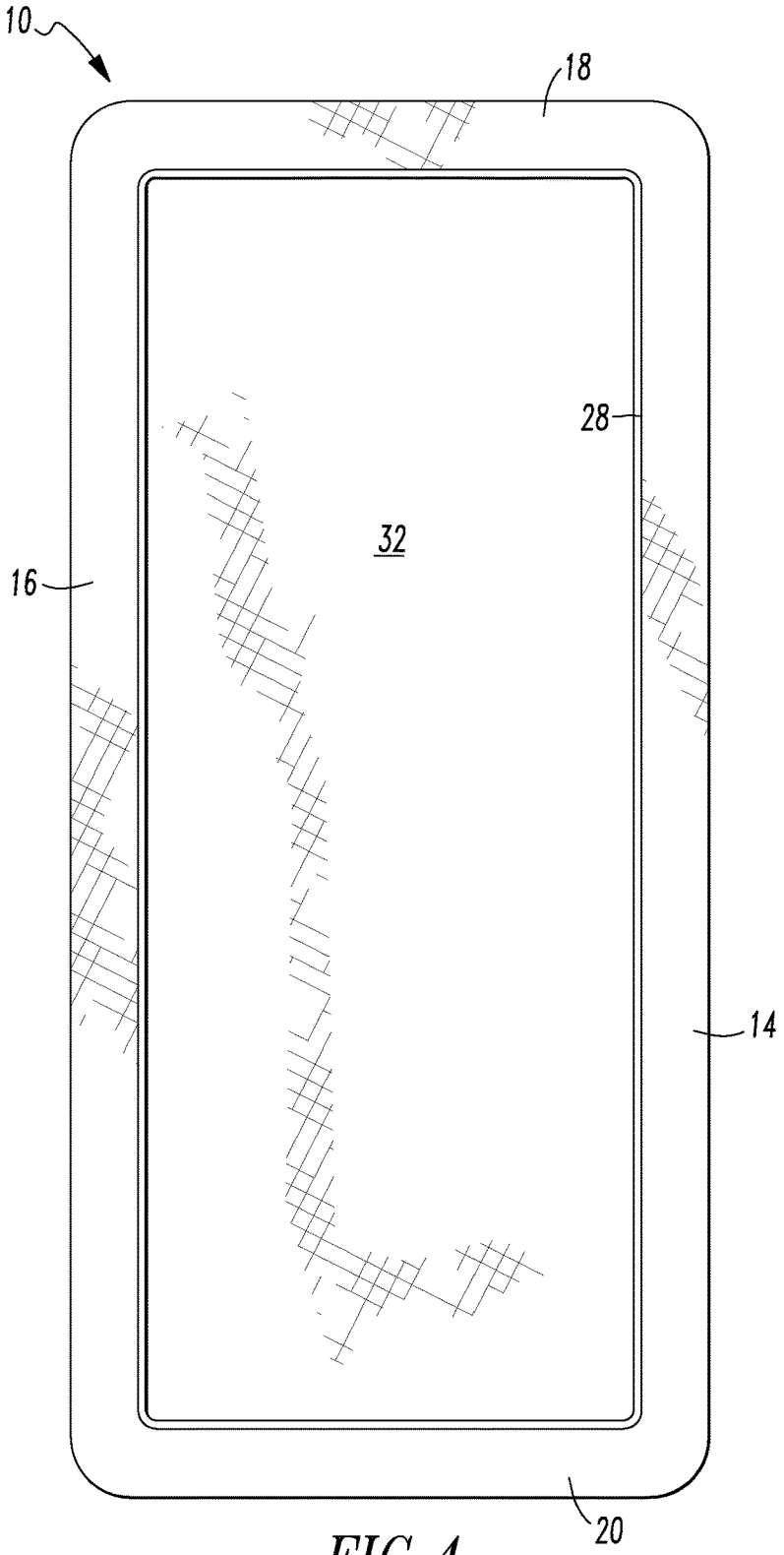
FIG. 4 is a bottom view of the fitted sheet on the XL-size twin mattress shown in FIG. 3.

As can be seen in FIGS. 2 and 4 elastic 28 is attached to the exposed edges of both side panels 14, 16 the front panel 18 and the rear panel 20. Alternatively, elastic can be attached to only the exposed edge of the first side panel 14 and to the exposed edge of the second the side panel 16.

The panels 12, 14, 16, 18, 20 may be formed as a single unitary member. Alternatively, any panel 12, 14, 16, 18, 20 or may be a separate piece that is attached to another piece or pieces via stitching or similar means. The fitted sheet 10 may be any textile or fabric material. This may include, but is not limited to, cotton, polyester, cotton and polyester blends, linen, flannel and fleece. The fitted sheet 10 may comprise a single material or a combination of different materials. Furthermore, the fitted sheet 10 may be a single layer or multiple layers of fabric or other material.

A standard-size twin mattress typically has a length dimension of 75 inches, and a standard twin XL mattress typically has a length dimension of 80 inches. When the fitted sheet 10 is placed over a mattress having a shorter length dimension, such as a standard-size twin mattress, the fitted sheet 10 is contracted in the lengthwise direction so as to enable a close-fitting engagement with the mattress. However, the same fitted sheet 10 may also be placed over a mattress having a longer length dimension, such as an XL-size twin mattress. When the fitted sheet is on the XL-size twin mattress, the elastic strips enable the fitted sheet 10 to expand in the lengthwise direction to cover the longer mattress and also provide a close-fitting engagement with the mattress. The standard-size twin mattress may have a different height that the XL-size mattress such that the amount of fabric that extends over the bottom of each mattress may be difference. Indeed, there may be some mattresses in which the sheet extends only down the sides of the mattress, in which case the bottom view of the mattress would not look like the bottom views shown in FIG. 2 or FIG. 4. Nonetheless, the elastic strips, 21, 22, 23 and 24 enable the fitted sheet 10 to effectively cover both the standard size and the XL size of these mattresses, while providing a close-fitting engagement.

The positions of the elastic strips 21, 22, 23 and 24 on the fitted sheet 10 illustrated throughout the figures are for exemplary purposes only. One skilled in the art will appreciate, with the benefit of the present disclosure, that the elastic strips 21, 22, 23 and 24 may be located elsewhere on the fitted sheet 10. For example, elastic strips 21, 22, 23 and 24 may be placed more towards the center of the top panel 12, or located on the side panels 14, 16.

It will be apparent to those skilled in the art that numerous modifications and variations of the described examples and embodiments are possible in light of the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of the following claims.

I claim:

1. A fitted sheet comprising:

a top panel having a length and a width;

a first side panel attached to the top panel and having an exposed edge;

a second side panel attached to the top panel and having an exposed edge;

a front panel attached to the top panel, the first side panel and the second side panel, the front panel having an exposed edge;

a rear panel attached to the top panel, the first side panel and the second side panel, the rear panel having an exposed edge;

wherein an enclosed first front corner is formed at a junction of the top panel the front panel, and the first side panel, an enclosed second front corner is formed at a junction of the top panel, the front panel and the second side panel, an enclosed first rear corner is formed at a junction of the top panel, the rear panel and the first side panel and an enclosed second rear corner is formed at a junction of the top panel, the rear panel, and the second side panel;

a first front elastic strip having a length and a width, the length being greater than the width, the first front elastic strip attached to at least one of the top panel and the first side panel adjacent the first front corner, the first front elastic strip extending toward the first rear corner such that the first front elastic strip is lengthwise substantially parallel to the first side panel;

a second front elastic strip having a length and a width, the length being greater than the width, the second front elastic strip attached to at least one of the top panel and the second side panel adjacent the second front corner, the second front elastic strip extending toward the second rear corner such that the second front elastic strip is lengthwise substantially parallel to the second side panel;

wherein the first front elastic strip and the second front elastic strip allow the fitted sheet to stretch and contract only in a lengthwise direction; and elastic attached to the exposed edge of the first side panel and elastic attached to the exposed edge of the second side panel.

2. The fitted sheet recited in claim 1 also comprising:

a first rear elastic strip having a length and a width, the length being greater than the width, the first rear elastic strip attached to at least one of the top panel and the first side panel adjacent the first rear corner, the first rear elastic strip extending toward the first front corner such that the first rear elastic strip is lengthwise substantially parallel to the first side panel; and a second rear elastic strip having a length and a width, the length being greater than the width, the second rear elastic strip attached to at least one of the top panel and the second side panel adjacent the second rear corner, the second rear elastic strip extending toward the second front corner such that the second rear elastic strip is lengthwise substantially parallel to the second side panel;

wherein the first rear elastic strip and the second rear elastic strip allow the fitted sheet to stretch and contract only in a lengthwise direction.

3. The fitted sheet recited in claim 1, also comprising elastic attached to the exposed edge of the front panel and elastic attached to the exposed edge of the rear panel.

4. The fitted sheet recited in claim 1, wherein the sheet is sized to cover a standard-size twin mattress and to cover an XL-size twin mattress.

5. The fitted sheet recited in claim 1 wherein the top panel, first side panel, the second side panel, the front panel, and the rear panel are formed from a single unitary piece of fabric.

6. The fitted sheet recited in claim 1 wherein the top panel, first side panel, the second side panel, the front panel, and the rear panel are made of a material selected from the group consisting of cotton, polyester, cotton and polyester blends, linen, flannel and fleece.

* * * * *